United States Patent [19]

Knowles

[11] Patent Number: 4,927,295

[45] Date of Patent: May 22, 1990

[54] RETRIEVABLE GUIDE POST SYSTEM

[75] Inventor: David G. Knowles, Cleckheaton, England

[73] Assignee: Cameron Iron Works USA, Inc., Houston, Tex.

[21] Appl. No.: 294,784

[22] Filed: Jan. 9, 1989

[30] Foreign Application Priority Data

Sep. 9, 1988 [EP] European Pat. Off. ..... 88308354.5

[51] Int. Cl.[5] ..... E02D 5/74; E21B 43/01

[52] U.S. Cl. ..... 405/195; 166/349

[58] Field of Search ..... 405/190, 191, 195, 224; 166/338, 339, 340, 349; 285/18

[56] References Cited

U.S. PATENT DOCUMENTS

| | | | |
|---|---|---|---|
| 3,967,460 | 7/1976 | Cassity | 166/349 X |
| 4,400,112 | 8/1983 | Castel et al. | 405/224 |
| 4,441,742 | 4/1984 | Owens | 285/18 |
| 4,443,130 | 4/1984 | Hall | 405/190 |
| 4,491,439 | 1/1985 | Watkins | 405/224 |
| 4,498,814 | 2/1985 | Brake | 405/224 |
| 4,523,878 | 6/1985 | Richart et al. | 405/195 |

*Primary Examiner*—David H. Corbin

[57] ABSTRACT

A retrievable guide post for installation in a subsea structure such as a template or a permanent guide base receptacle and for retrieval therefrom including a tubular body, a sleeve slidable axially on the lower exterior of the tubular body, a groove in the exterior of the sleeve a short distance below its upper end, a groove in the exterior of the tubular body a short distance above the uppermost position of the upper end of the sleeve, a split latching ring supported on the exterior of the tubular member immediately below the lower end of the sleeve in its upper position, a support ring positioned below the split latching ring to support the latching ring at its desired latching level, a pin and slot connection between the support ring to the tubular body to allow relative limited axial motion of the support ring on the tubular body and a shear pin releasably securing the support ring to the tubular body.

16 Claims, 9 Drawing Sheets

RETRIEVABLE GUIDE POST SYSTEM

BACKGROUND

The present invention relates to a retrievable guide post system for the guide posts of a permanent subsea guide base or a subsea template which may be readily removed when damaged or bent and replaced with a new guide post.

Prior to the present invention, guide posts have been remotely installed and retrieved but they were not suitable for the retrieval of bent or damaged guide posts since they rely for their release on the exertion of a downward force on the upper end of a release sleeve at the upper end of the post to release latches which latch into the guide post receptacle. An example of this type of guide post is shown in the "Remote Guidepost System" of FMC as shown in the Composite Catalog published by Gulf Publishing Company for 1988–1989, page 1502.

U.S. Pat. No. 4,523,8778 discloses a structure for the replacement of damaged guide posts which are attached to a receptacle which is a part of a subsea structure. The guide post includes radially extending spring loaded lock pins which engage within a groove in the guide post receptacle and, when damaged, the guide posts are retrieved by an upward pull of sufficient force to shear the lock pins to thereby obtain the release of the guide post from its receptacle and recovered to the surface and a replacement is installed in the receptacle with the aid of a television camera for ensuring proper orientation.

SUMMARY

The present invention provides an improved retrievable guide post for a subsea template which is secured and released through the action of a hydraulic tool and also can be released through the use of a separate pulling tool to provide a shearing of shear pins to allow the release of the latch into the receptacle. The receptacle includes the usual funnel and a groove in the cylindrical inner surface of the receptacle below the funnel, a guide post body, a tool which can be lowered over the guide post body and set in engagement with the body and which includes a ring with means for engaging in a groove in the sleeve which slides within a split latching ring to wedge it into engagement with the receptacle inner groove and an actuator for moving the ring downwardly with respect to the tool to cause the downward movement of the sleeve and also to raise the ring to slide the sleeve upwardly to allow the retraction of the split latching ring from its engagement with the receptacle inner groove, and further a suitable interengagement of the guide post body and the sleeve including shear pins which shear responsive to an upward load on the body and allow the upward movement of the body to raise the sleeve from within the split latching ring to allow its disengagement from the receptacle inner groove and the retrieval of the guide post.

An object of the present invention is to provide an improved retrievable guide post which can be retrieved and installed with a usual retrieving tool and also can be retrieved solely by an upward load on the guide post without damage to the receptacle or the template to which the receptacle is secured.

A further object is to provide an improved retrievable guide post whose retrieval is ensured independent of the damage to the guide post, provided the subsea receptacle is undamaged.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
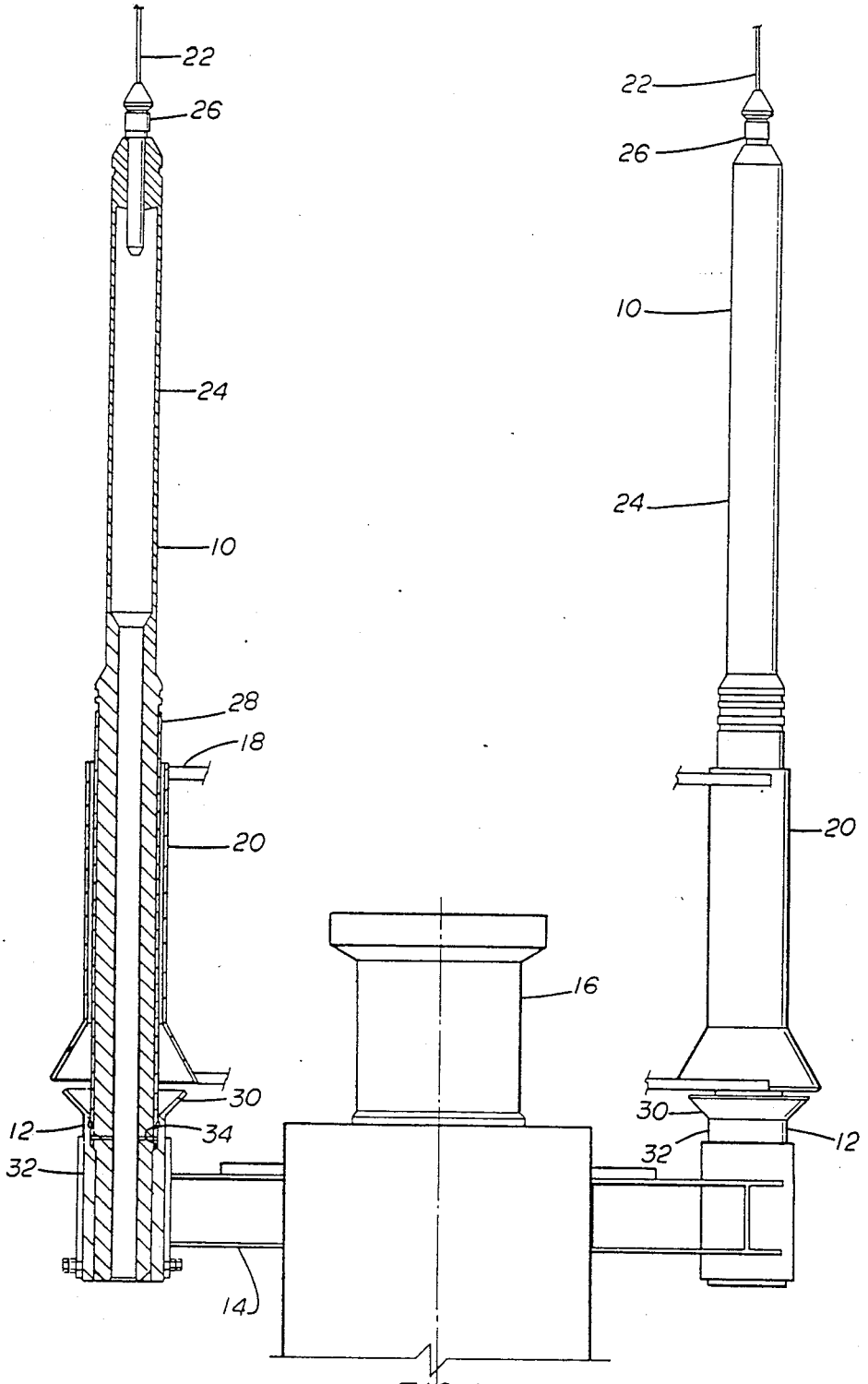
FIG. 1 is an elevation view of a subsea wellhead having a guide base or template with upwardly extending guide posts of the present invention and showing one of the guide posts in section.
Figure 6:
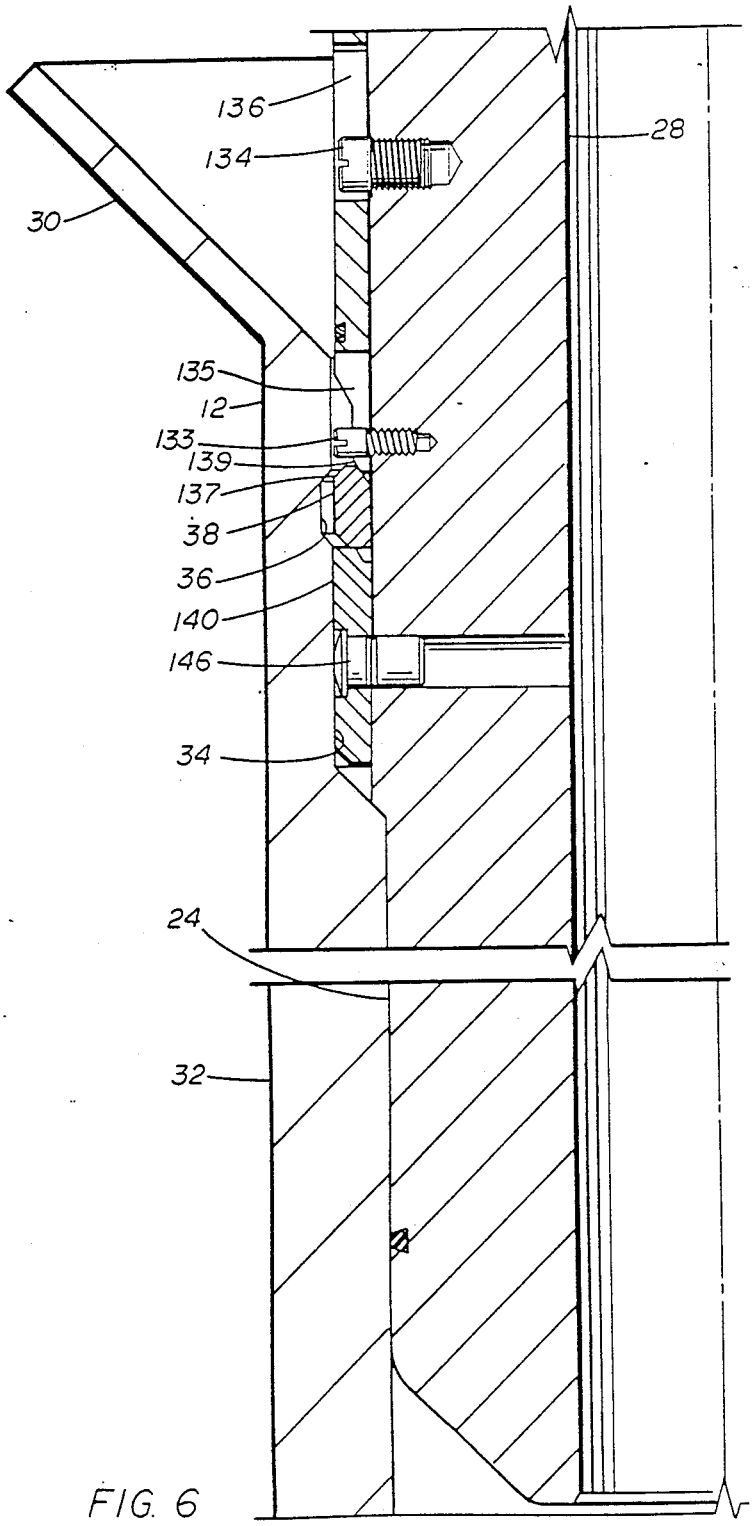
FIG. 6 is a partial sectional view through the guide post landed in the subsea receptacle but prior to its latching engagement therewith.
Figure 7:
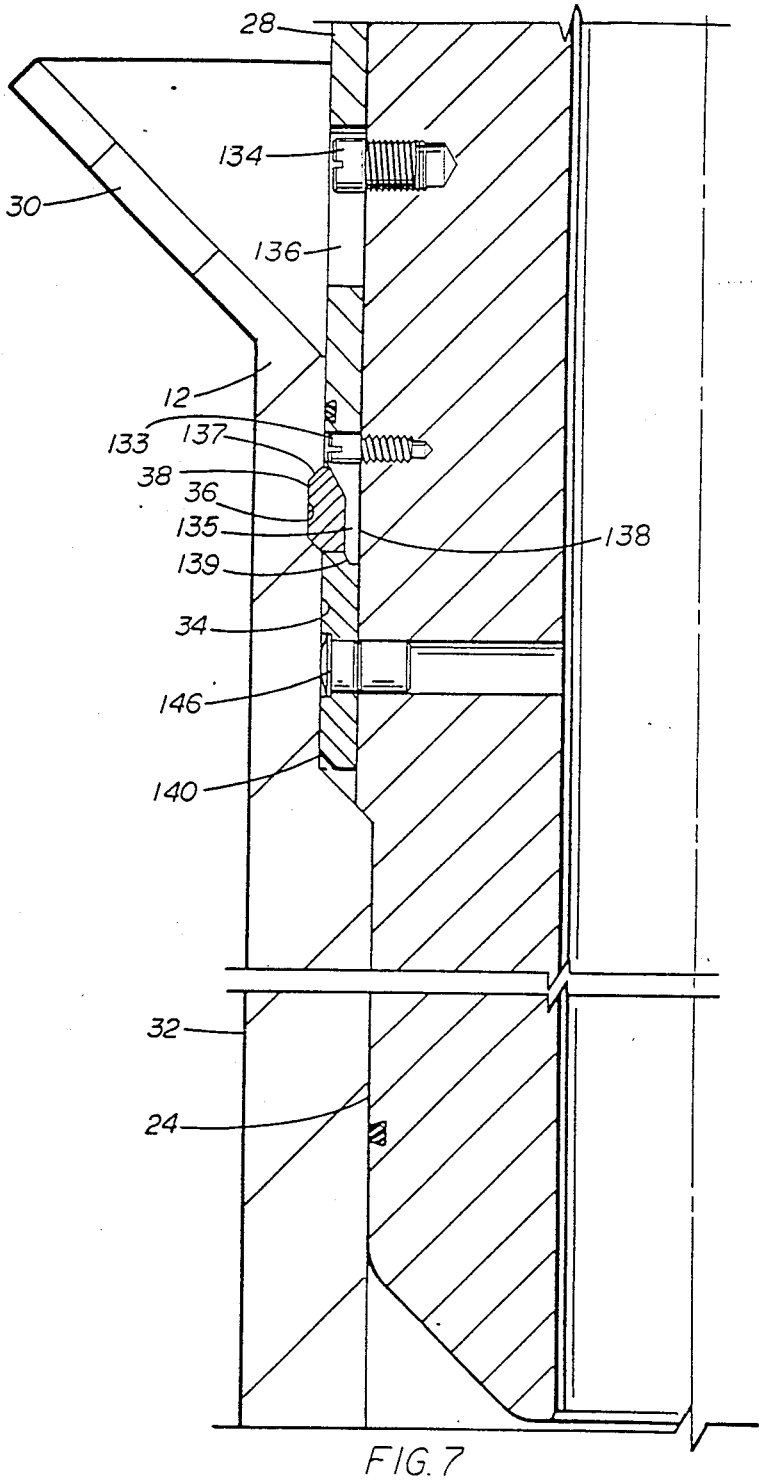
FIG. 7 is another partial sectional view of the guide post and the receptacle illustrating the latching of the guide post within the receptacle.

As shown in FIG. 1, improved guide posts 10 of the present invention are installed within the receptacles 12 of the subsea floor structure 14, such as a guide base or a template with wellhead 16 located within the opening through structure 14. Guide frame 18 which has its tubular legs 20 surrounding guide posts 10 is used for the lowering of tools and strings into the wellhead and can be used for retrieving and installing the guide posts 10 by provide location guidance from the guide cables 22 and the other guide posts during the lowering of tools and the replacement guide post. Guide post 10 includes tubular body 24 including cable attachment 26 secured to the upper end of body 24 with cables 22 extending therefrom to the surface (not shown). Sleeve 28 surrounds the lower portion of tubular body 24 and extends into receptacle 12 as shown. Receptacle 12 includes an upwardly and outwardly flaring funnel 30 and a tubular body 32 extending downwardly from the funnel 30 and being secured as a part of subsea structure 14. The upper portion of body 32 is counterbored at 34 and includes latching groove 36 therein to receive split latching ring 38 therein when it has been forced outwardly into engagement with groove 36, as best seen in FIGS. 6 and 7.

Figure 3:
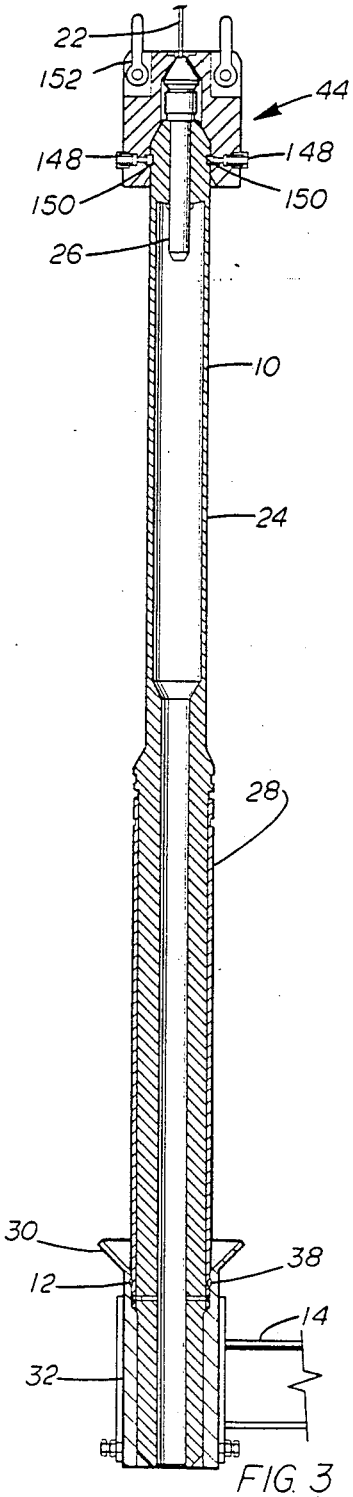
FIG. 3 is an elevation view taken in section to illustrate the improved guide post with the pulling tool secured to the upper end of the guide post.
Figure 4:
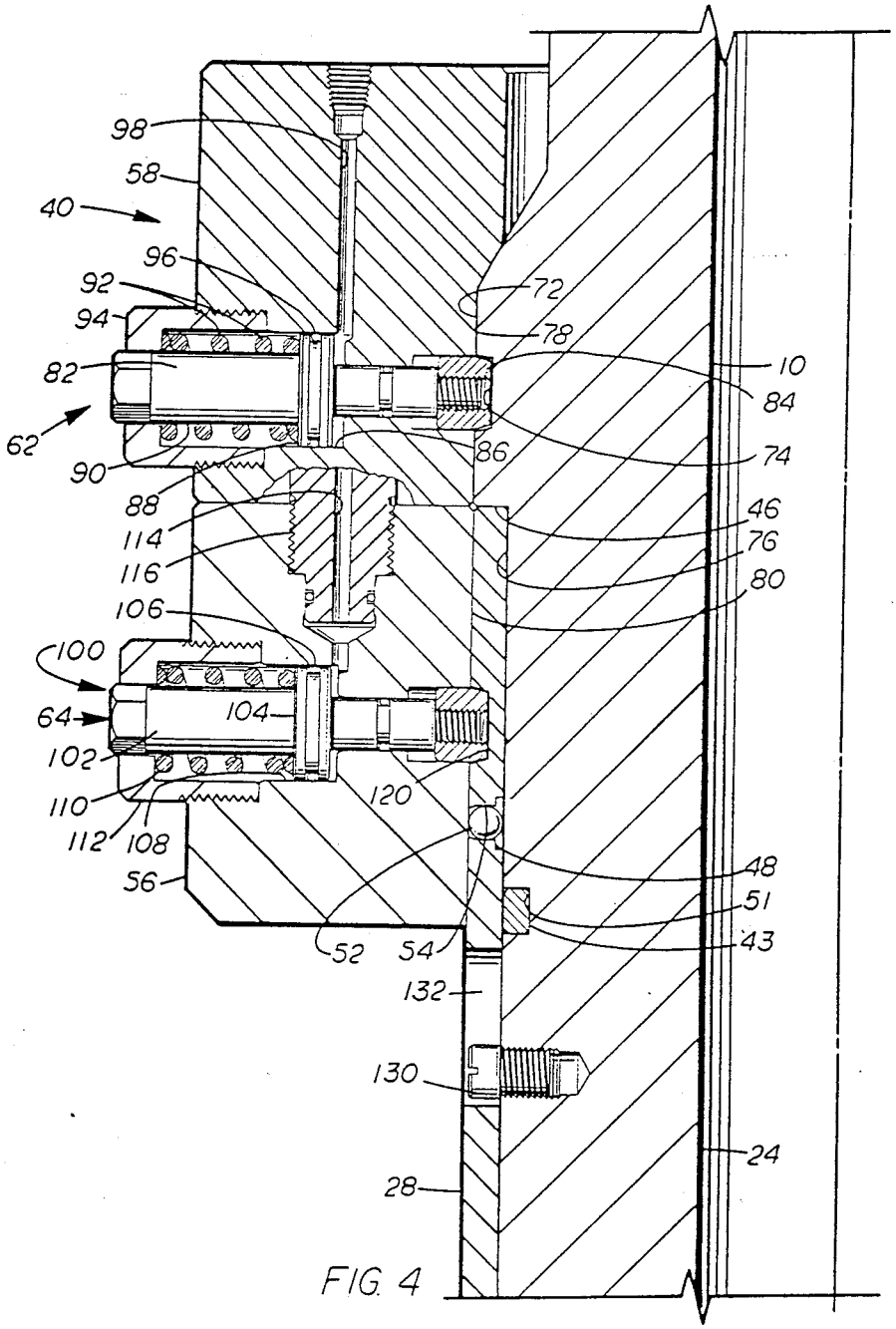
FIG. 4 is a partial sectional view of the improved guide post installation tool with the sleeve in its unlatched position.
Figure 5:
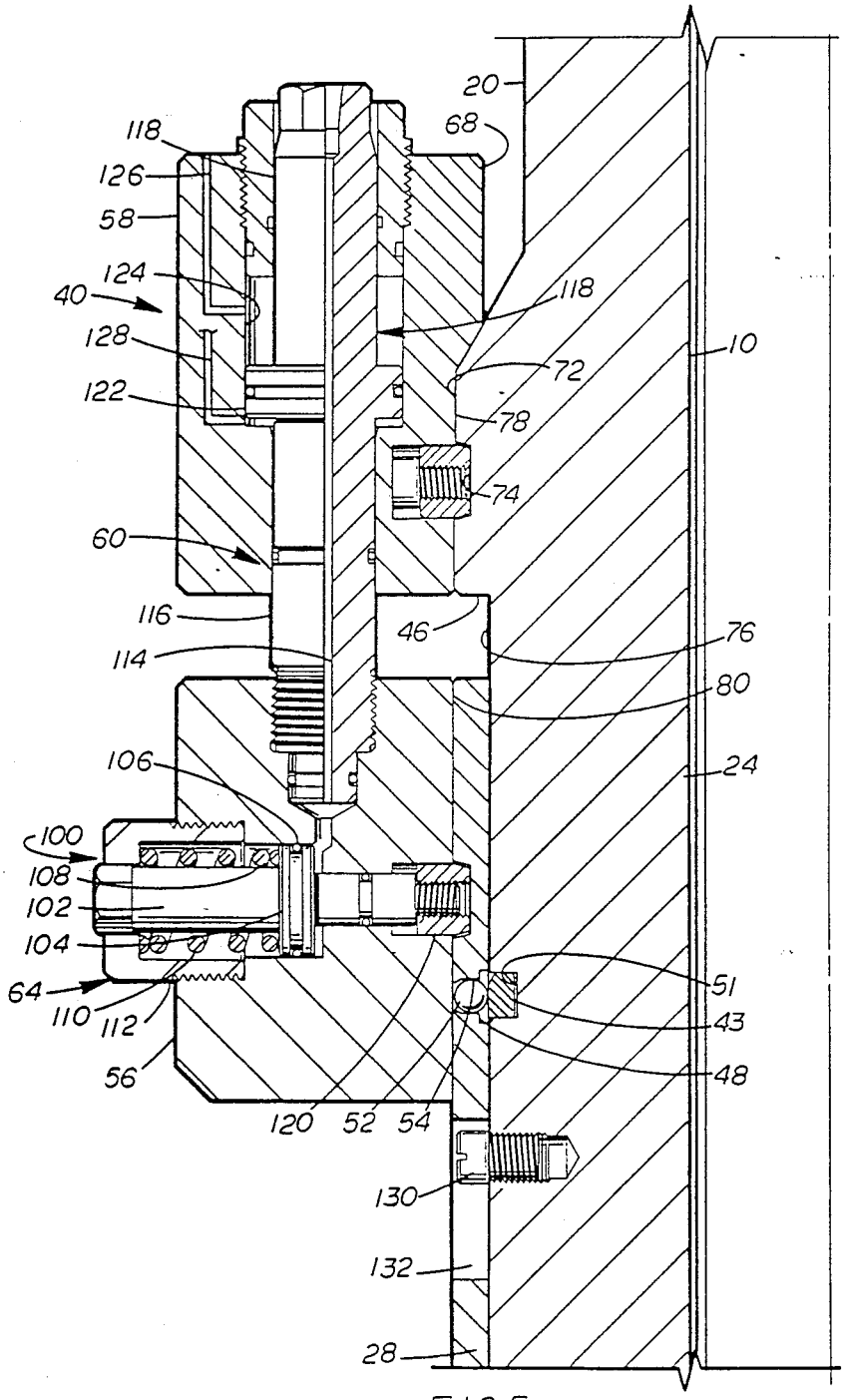
FIG. 5 is another partial sectional view of the installation tool with the sleeve moved to its latched position.

The installation and retrieval of guide post 10 is normally accompanied by the positioning of running and retrieval tool 40 in engagement with guide post 10 as hereinafter described. Tool 40 is normally actuated on installation to cause its upper ring to engage body 24 and its lower ring to engage sleeve 28. Sleeve locking ring 43 (as best seen in FIGS. 4 and 5) which lock sleeve 28 in its latched position allows the installation of tool 40 so that on actuation of tool 40 sleeve 28 is moved downward thereby wedging split latching ring 38 within the receptacle groove 36. Once installation is complete, the engagement of upper ring and lower ring of tool are disengaged hydraulically as hereinafter explained and then tool 40 can be removed and retrieved to the surface. Removal of guide post 10 is achieved by essentially reversing the procedure as by raising sleeve 28 to release split latching ring 38 and allow retrieval of guide post 10. FIG. 3 is a sectional view of guide post 10 secured within its receptacle 12 and having pulling tool 44 secured to the upper end of guide post 10. As shown in FIGS. 4 and 5, sleeve 28 is slidable on the exterior of tubular body 24 below downwardly facing shoulder 46 and, in the absence of running and retrieval tool 40 being secured thereon, is secured in its latched position by the engagement of one of split sleeve locking ring 43 within inner groove 48 on the interior of sleeve 28 and also in groove 51 on the exterior of body 24. A plurality of balls 52 are secured within ports 54 in sleeve 28 and are in a position extending partially beyond the outer surface of sleeve 28 until tool 40 is installed thereon. After tool 40 is installed, lower ring 56 of tool 40 engages balls 52 and wedges them inwardly with ports 54 and following actuation of sleeve 28, balls 52 move split latching ring 43, which is in registry with balls 52, back into its groove 50 or 51 on the exterior of tubular body 24 to latch sleeve 28 in its actuated position.

Figure 2:
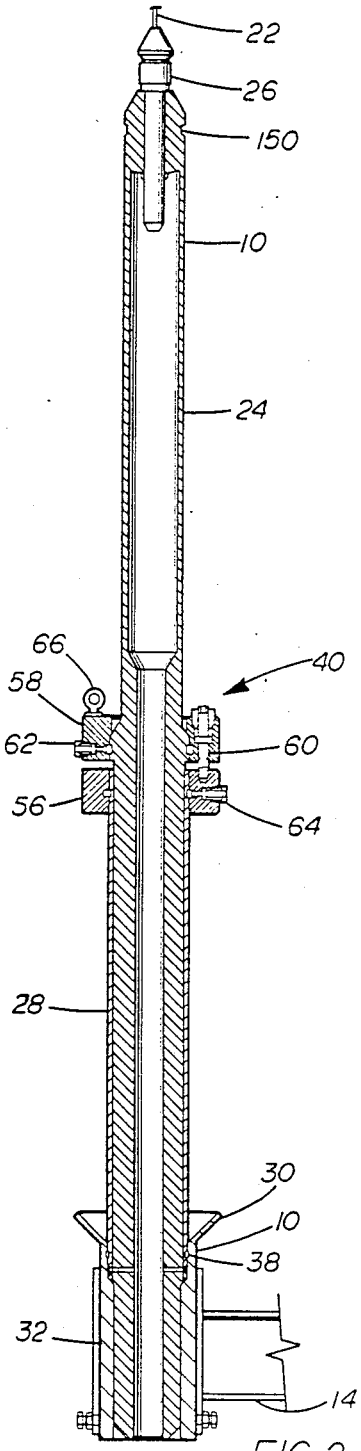
FIG. 2 is an elevation view taken in section to illustrate the improved guide post with the installation tool secured thereto and the sleeve in latching position.

Running and retrieving tool 40 includes upper ring 58, lower ring 56, means 60 connecting between rings 56 and 58 for moving them axially relative to one another, means 62 for securing upper ring 58 to the exterior of tubular body 24 of guide post 10 and means 64 for securing lower ring 56 to the exterior of sleeve 28 as shown in FIG. 2 and hereinafter described in detail with reference to FIGS. 4 and 5. Tool 40 includes lifting eyes 66 (preferably three) secured to the upper surface of upper ring 58 for lowering and retrieving tool 40, guided on cable 22 into position around tubular body 24 and sleeve 28 as shown in FIGS. 2, 4 and 5 and to retrieve it therefrom.

Upper ring 58 includes upper inner surface 68 which is larger than the diameter of external surface 70 of tubular body 24. The exterior of tubular body 24 at the lower end of surface 70 tapers downwardly and outwardly to external surface 72. Surface 72 includes groove 74 approximately mid way to downwardly facing shoulder 46 which is the end of external surface 72 and the beginning of external surface 76 on which sleeve 28 is slidably mounted. Upper ring 58 tapers outwardly and downwardly at the lower end of inner surface 68 to inner surface 78 which is slightly larger than external surface 72 so that it will slide thereon to the position illustrated in FIGS. 4 and 5 with the internal taper of upper ring 58 seated on the external taper of tubular body 24. Inner surface 80 on lower ring 56 is sufficiently large to pass readily over surface 72 of tubular post body 24 and over the exterior of sleeve 28. As seen in FIG. 4, upper ring 58 includes a plurality of spring loaded plungers 82 which extend radially inward and have their inner ends 84 suitably sized to engage within groove 74 on the exterior of body 24 to secure upper ring in its operating position of guide post 10. Each of plungers 82 is positioned within radial bore 86 as shown in FIGS. 4 and 5 and includes sealing collar 88 secured to plunger shaft 90 with spring 92 surrounding the outer end of shaft 90 between collar 88 and the inner surface of cap 94. Collar 88 includes seal 96 which seals against the interior of bore 86 so that pressure delivered through passage 98 to the inner surface of collar 88 will result in the force of spring 92 being overcome and plunger 82 moving radially outward out of engagement with groove 74. Thus, plungers 82 provide means 62 for securing upper ring 58 to the exterior of tubular post body 24. Plungers 100 which is of a similar structure to plungers 82 provide means 64 for securing lower ring 56 to sleeve 28. Each of plungers 100 includes shaft 102 with collar 104 mounted thereon and sealed by seal 106 against the interior of bore 108 with spring 110 urging plunger 100 radially inward from its position surrounding the outer portion of shaft 102 and its engagement between collar 104 and cap 112. Pressure delivered through passage 114 extending through the interior of body 116 of actuator 118 is exerted on the interior surface of sealing collar 104 to cause plunger 100 to move radially outward and thus out of engagement with groove 120 on the upper exterior of sleeve 28.

Actuator 118 includes collar 122 which seals against the interior of vertical bore 124 in which it is mounted and actuator body 116 extends downwardly into threaded engagement into the upper portion of lower ring 56. Pressure delivered through passage 126 to the annular chamber above collar 122 causes body 116 to move downwardly to the position illustrated in FIG. 5 from the position illustrated in FIG. 4. Actuator 118 is retracted by delivering pressure through passage 128 to the annular chamber below collar 122 and venting the pressure in passage 126. This movement by actuator causes the axial movement of lower ring 56 which when it is secured to sleeve 28 will slide sleeve 28 along the exterior of the lower portion of tubular post body 24. Since each of plungers 82 and 100 can be controlled to retract from their grooves 74 and 120, there is no problem in securing and releasing tool 40 to and from the exterior of tubular post body 24 and to and from the exterior of sleeve 28. Proper operation of actuator 118 will create the desired movement of sleeve 28 and the consequent setting and release of split latching ring 38. Guide pin 130 is secured to the exterior of tubular body 24 and extend outward therefrom and is positioned within upper slot 132 in sleeve 28.

Figure 8:
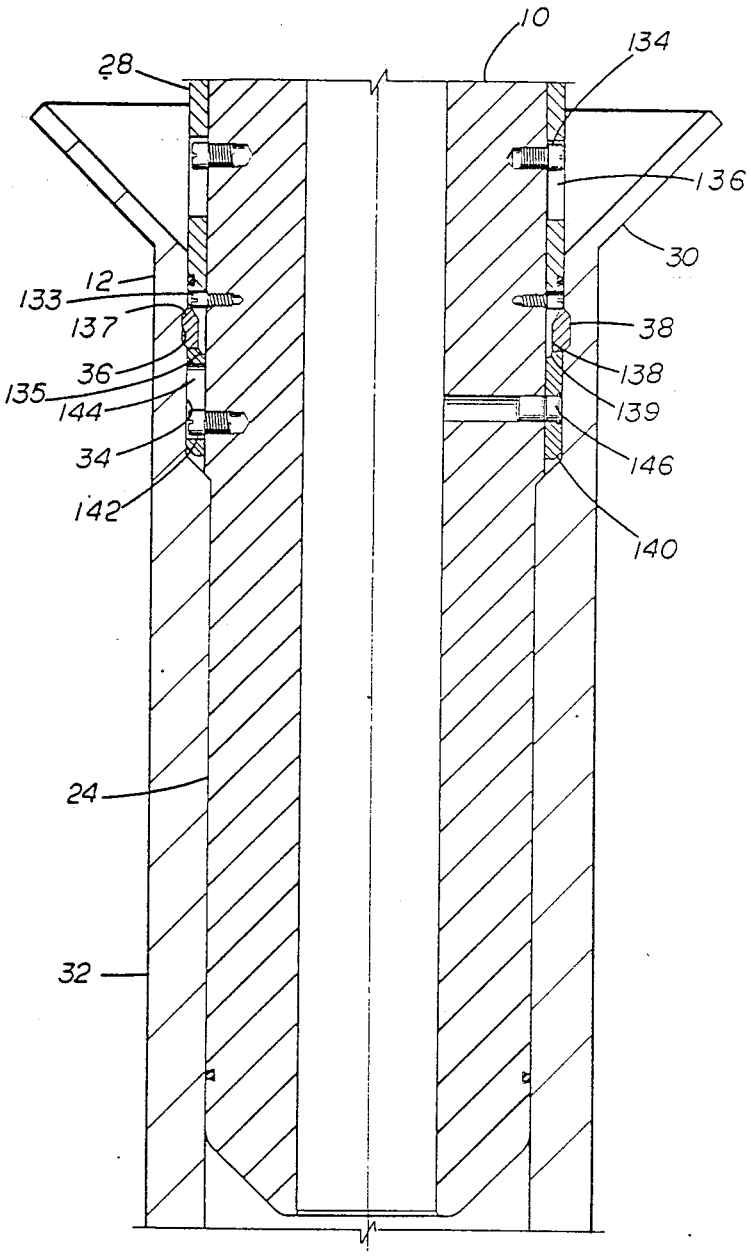
FIG. 8 is a sectional view of the guide post latched within the receptacle and illustrating the shear pin connecting the support ring to the guide post.
Figure 9:
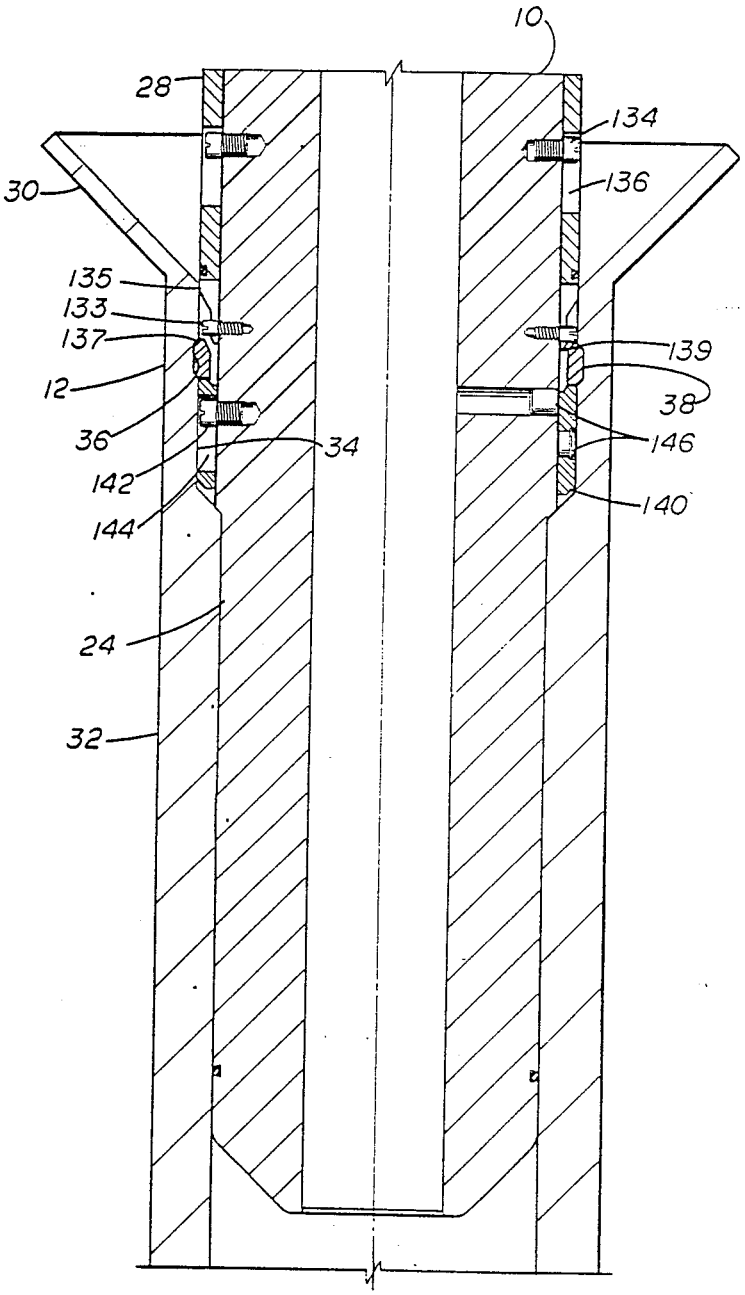
FIG. 9 is another sectional view of the guide post illustrating the shearing of the shear pins and initial upward movement or the guide post.
Figure 10:
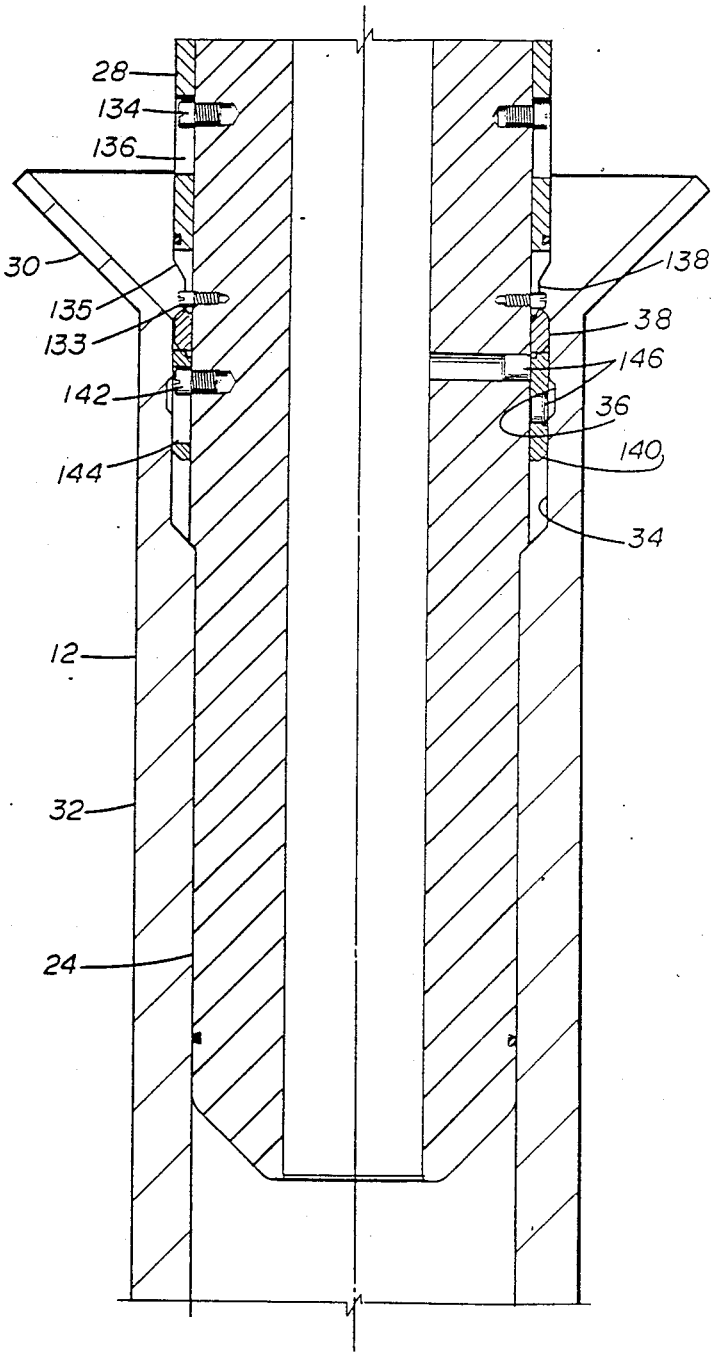
FIG. 10 is another sectional view of the guide post illustrating its release from its receptacle through the action of shearing the shear pin.

The operation of the lower end of sleeve 28 and its coaction with split latching ring 38 is illustrated in FIGS. 6 and 7. Guide pins 134 which are secured to the exterior of the lower end of tubular body 24 extend outward therefrom and are positioned within lower slots 136. Studs 133 are secured to the exterior of the lower end of tubular body 24 below guide pins 134 and extend outward therefrom and are positioned within slots 135 on the lower end of sleeve 28. Studs 133 engage the upper end of locking ring 38 to maintain it in alignment with receptacle groove 36. Sleeve 28 is tapered on its lower end to provide a reduced rim 138 having a lower tapered wedging surface 139 which engages within the upper tapered surface of split latching ring 38. Support ring 140 is positioned within the lower end of counterbore 34 and, as shown in FIGS. 8, 9 and 10, includes guide pin 142 (preferably more than one) secured in the exterior of tubular body 24 extending outward into vertical slot 144 in ring 140. Additionally, shear pins 146 (preferably more than one) are secured into the exterior of tubular body 24 and in support ring 140. In this position ring 140 positions split latching ring 38 so that it is in registry with groove 36 on the interior of receptacle 12. Thus when sleeve 28 moves downward from the position shown in FIG. 6, its lower rim 138 wedges split latching ring 38 from its inward position to its latching position within groove 36 as shown in FIG. 7. Retrieval of guide post 10 is simply the reverse operation by which sleeve 28 is raised and split latching ring 38 is allowed to retract so that guide post 10 is released from receptacle 12 and can be retrieved to the surface.

The alternate retrieval system is illustrated in FIGS. 3, 8, 9 and 10 is utilized to retrieve guide post 10 when the normal retrieval fails, usually because of damage. With pulling tool 44 secured to the upper end of guide post 10 by the engagement of plungers 148 within external groove 150 around the upper exterior of tubular body 24 and having suitable lifting bales 152 secured thereto and having direct connection to the surface for the exertion of substantial lifting forces on guide post 10 when it is stuck in its receptacle 12. With the exertion of sufficient force, shear pins 146 are sheared and tubular body and sleeve 28 move upwardly as shown by the difference in positions between FIGS. 8 and 9. This allows support ring 140 and split latching ring 38 to remain in their latched positions. As guide pin 142 reaches the upper end of slot 144, support ring 140 engages the lower surface of split latching ring 38 and because of the engagement of tapered surface on the upper end of groove 36 with tapered surface 137 on latching ring 38, the upward force exerted on latching ring 38 causes it to be cammed inwardly to its released position and allow further upward movement of the complete assembly of components as shown in FIG. 10.

What is claimed is:

1. A retrievable guide post comprising a tubular body having external means for engagement of said tubular body near its upper end, a sleeve surrounding and axially movable along the lower portion of the tubular body and having an upper end and a lower end, said lower end having a reduced wedging rim and external means for engagement of said sleeve close to the upper end, a split latching ring supported on said body and coacting with said sleeve wedging rim, a support ring positioned around said tubular body below said split latching ring, means releasably securing said support ring to said tubular body, and means connecting said support ring to said tubular body allowing a limited axial movement between said support ring and said tubular body whereby lifting forces on said tubular body can be transmitted to said split latching ring.

2. A retrievable guide post according to claim 1 including means for releasably securing said sleeve to said tubular body in its set position and its latching position.

3. A retrievable guide post according to claim 2 wherein said releasable sleeve securing means includes an upper external groove in the exterior of said tubular body, a lower external groove in the exterior of said tubular body and spaced a preselected distance below said upper external groove, a split locking ring positioned in said upper groove, a split locking ring positioned in said lower groove, a groove on the interior of said sleeve, and means contained within said sleeve and exposed to said interior sleeve groove for coacting with said split locking rings so that the one of said rings within the interior sleeve groove is forced radially inward responsive to a ring engaging the exterior of said sleeve in the area of said sleeve interior groove.

4. A retrievable guide post according to claim 3 wherein said coacting means includes a plurality of balls positioned in recesses in said sleeve and engaging the split locking ring positioned within said interior sleeve groove so that a portion of said balls extend beyond the exterior surface of said sleeve a sufficient distance so that depressing said balls totally into their recesses moves the split locking ring inward out of engagement within the interior sleeve groove.

5. A retrievable guide post according to claim including means for securing a guide cable to the upper end of said tubular body.

6. A retrievable guide post according to claim 1 wherein said releasable securing means includes a plurality of shear pins securing said support ring to said tubular body, and said connecting means includes a plurality of vertical slots in said support ring, and a plurality of guide pins secured to said tubular body and positioned in said slots.

7. A retrievable guide post according to claim 1 including a subsea receptacle for receiving said guide post having a central bore and an upper counterbore with an internal latching groove within said counterbore, said latching groove being positioned to receive said split latching ring for latching said tubular body into said receptacle.

8. A retrievable guide post according to claim 7 including an upper funnel, and downward from said a lower tubular body extending funnel.

9. A retrievable guide post according to claim 8 including a subsea structure secured to a plurality of said receptacles for receiving a guide post in each receptacle.

10. A retrievable guide post according to claim 9 wherein said subsea structure surrounds a subsea wellhead.

11. A retrievable guide post according to claim 9 wherein said subsea structure is a template.

12. A retrievable guide post according to claim 9 wherein said subsea structure is a permanent guide base.

13. A tool for setting and retrieving a retrievable guide post having a tubular body, a sleeve slidable axially on the lower exterior of the tubular body, a groove in the exterior of the sleeve a short distance below its upper end, a groove in the exterior of the tubular body a short distance above the uppermost position of the upper end of the sleeve, and a split latching ring supported on the exterior of the tubular member immediately below the lower end of the sleeve in its uppermost position comprising a first ring having an interior adapted to be lowered into surrounding relationship to the tubular body and having means for engaging within the tubular body groove to secure said first ring to said tubular body, a second ring having an interior adapted to be lowered into surrounding relationship with the upper end of the sleeve and having means for engaging within the sleeve exterior groove to secure said second ring to said sleeve, and actuating means interconnecting said first and second rings to cause said rings to move axially apart and to return the rings to adjacent positions.

14. A tool according to claim 13 wherein said engaging means includes a plurality of plungers extending radially through each of said first and second rings and when extended inward engages within a groove in one of said tubular body and said sleeve.

15. A tool according to claim 14 including means biasing said plungers radially inward.

16. A tool according to claim 15 wherein said plungers are responsive to fluid pressure for retracting radially outward.

* * * * *